US007527430B2

(12) United States Patent
Suskind

(10) Patent No.: US 7,527,430 B2
(45) Date of Patent: May 5, 2009

(54) ADJUSTABLE FOLDING BAG WITH SELF-CENTERING HANDLE

(76) Inventor: Sydnie Allison Suskind, 2646 Midvale Ave., Los Angeles, CA (US) 90064-4214

( * ) Notice: Subject to any disclaimer, the term of this patent is extended or adjusted under 35 U.S.C. 154(b) by 333 days.

(21) Appl. No.: 11/463,271

(22) Filed: Aug. 8, 2006

(65) Prior Publication Data

US 2008/0037907 A1 Feb. 14, 2008

(51) Int. Cl.
*B65D 30/00* (2006.01)

(52) U.S. Cl. ..... 383/2; 383/24; 383/62; 383/88; 383/89; 190/103

(58) Field of Classification Search ..... 383/2, 383/14, 24, 30, 62, 76, 79, 88, 89, 92; 190/103
See application file for complete search history.

(56) References Cited

U.S. PATENT DOCUMENTS 1,657,639 A * 1/1928 Roy ..... 426/110
1,802,276 A * 4/1931 Schardt ..... 383/91
3,147,673 A * 9/1964 Hilton ..... 493/221
3,229,741 A * 1/1966 Ambrose ..... 383/2
3,314,464 A * 4/1967 Veilleux ..... 150/154
3,366,313 A 1/1968 Culberg et al.
3,658,240 A 4/1972 Stoll
4,608,283 A 8/1986 White
5,556,025 A 9/1996 Sloan
6,012,842 A 1/2000 Openiano
6,092,932 A 7/2000 Pekala et al.
6,109,440 A 8/2000 Cliff
6,405,869 B1 6/2002 Whittemore et al.
7,018,100 B2 3/2006 Clark
2002/0096122 A1 * 7/2002 Efrati et al. ..... 119/168
2006/0060642 A1 3/2006 Rosier

FOREIGN PATENT DOCUMENTS

GB 2380183 A 2/2003

* cited by examiner

*Primary Examiner*—Nathan J Newhouse
*Assistant Examiner*—Jack H Morgan, Jr.
(74) *Attorney, Agent, or Firm*—Holland & Knight LLP; Richard E. Lyon, Jr.

(57) ABSTRACT

An adjustable carrying bag having an open upper end and a closed lower end and being formed of a front panel and a rear panel. The panels are foldable about a vertically variable horizontal axis to close the bag such that by varying the vertical elevation of the fold, one varies the volumetric area of the bag. Attachment members are provided for releasably securing the front and rear panels in a folded and vertically adjustable disposition. A handle is slidably mounted on the rear panel such that upon folding the front and rear panels, securing the panels in a folded disposition and lifting the bag by the handle, the handle will slide to the top of the folded bag for carrying irrespective of the vertical elevation of the fold along the bag.

23 Claims, 7 Drawing Sheets

ADJUSTABLE FOLDING BAG WITH SELF-CENTERING HANDLE

BACKGROUND OF THE INVENTION

The present invention relates to flexible containers, and in particular to a carrying bag that is adjustable in volume and has adjustable self-centering handles. The carrying bag of the present invention can be used in various embodiments as an adjustable gift bag, a shopping bag, a purse and in a variety of other container configurations in which variations in volumetric capacity and a convenient carrying handle are desirous.

Carrying bags of a wide variety of shapes, styles and sizes have long been used to carry items from one place to another. The contents of these containers vary widely and most containers are not customized to handle variations in the size of the cargo, particularly inexpensive carrying bags made of paper such as gift bags and shopping bags. Traditionally, gifts from one person to another are wrapped in a decorative manner to provide a visually exciting and pleasing appearance, retain an element of mystery as to the identity of the gift, and sometimes to enhance the prestige of the gift itself. A trend is to place gifts inside decorative bags, with the bag itself serving as both container and decorative wrapper. Thus, gifts placed in gift bags need not be first placed in another box and then wrapped before presentation. However, because the gift is not truly hidden when received and the bag is not generally sized for the gift inside, the bag does not appear to be customized for the particular gift, detracting from its presentation and from the thrill and anticipation of receiving the gift. It would be desirable if the gift bag were closed so as to conceal the gift inside and adjustable in size so that the bag would appear customized for the gift inside. It would also be desirable if an inexpensive handle could be provided on the bag that was self adjusting for conveniently carrying the closed gift laden bag regardless of the size to which the bag had been formed.

In other instances, it also would be beneficial to have a closeable inexpensive container such as a paper bag and be able to change the dimension of the container to match the size of its contents for security and/or aesthetic purposes. For example, a department store type bag is normally an open, one-sized bag for carrying merchandise. Even if the bag can be closed manually and wrapped around itself, there is no convenient way to pick up the wrapped bag because the fixed loop handle typically provided on such bags either becomes covered by the upper portion of the wrapped bag or, if exposed, is not properly positioned for conveniently carrying the wrapped bag and its contents. As will be seen, there is a widespread need in multiple applications for a variable-sized, closeable container that can conceal and better protect the merchandise contained therein and that can be easily carried by a properly positioned handle.

BRIEF SUMMARY OF THE INVENTION

The carrying bag of the present invention is volumetrically adjustable in that the open upper portions of the front and rear panels of the bag can be pressed together and folded over and about the object(s) within the bag such that the upper portion of the rear panel is disposed adjacent and over the upper portion of the front panel. The two panels may then be secured against a lower portion of the front panel to maintain the bag in a closed and folded disposition. The location of the fold is at the option of the user and may depend upon the size and shape of the object(s) within the bag. By providing an adjustable securement that allows for variations in the positioning of the fold, the bag is rendered volumetrically adjustable. The carrying bag also is provided with a pair of laterally spaced, parallel, vertical slits in the rear panel through which the handle extends. The slits allow for the handle to be freely slideable upwardly and downwardly along the rear container panel and are of sufficient length such that almost regardless of the location of the fold along the bag, the bag handle, when used to carry the bag, always will position itself at the top of the bag, allowing for easy carrying.

DESCRIPTION OF THE PREFERRED EMBODIMENT

Figure 2:
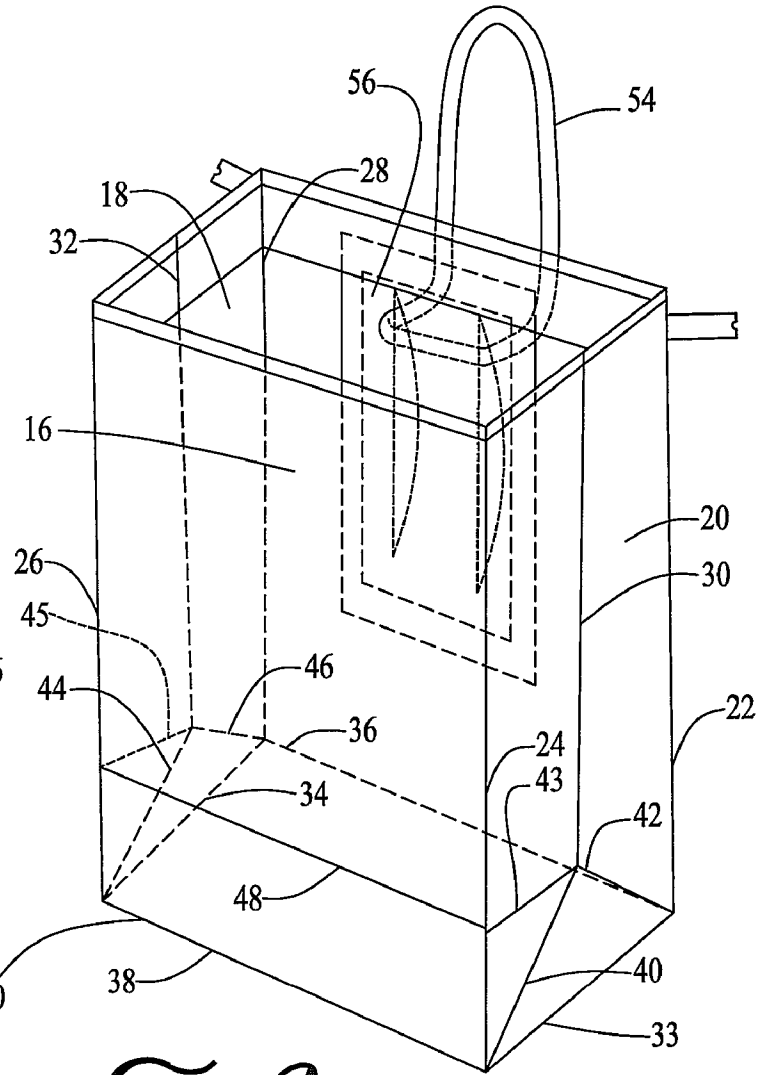
FIG. 2 is a front perspective view of the first embodiment of the present invention illustrating the bag in the open position.

Referring now in detail to the drawings, the embodiment of the present invention shown in FIGS. 1-9 is a foldable paper bag 10 of the type used as a gift bag or shopping bag. Bag 10 has an open upper end 12 and preferably defines a rear panel 14, a front panel 16, side panels 18 and 20 and a plurality of fold lines 22-48 (see FIG. 2) that allow the bag 10 to be collapsed in a flat disposition as is typical in the formation of gift or shopping bags. It is to be understood, however, that bag 10 also could be formed of cardboard, canvas, leather, plastic, cloth or any other suitable material and that the folds are not all necessary for the proper functioning of the present invention.

The rear panel 14 of bag 10 has a pair of laterally spaced elongated openings or slits 50 and 52 on the outside surface of the bag. A handle 54, preferably in the form of a closed loop, extends through the openings and about the portion 53 of the rear panel disposed between opening 50 and 52 (see e.g. FIGS. 1 and 2), affixing the handle to the bag and allowing the handle to slide freely upwardly and downwardly along the rear side of the bag. The handle 54 is preferably made of a loop of string or rope for a gift or shopping bag application, but may be made of any suitable material, including but not limited to leather, metal and plastic, etc., depending on the particular application. For example, if the bag configuration in which the present invention was being employed was a purse or tote bag, the handle would more preferably be made of leather, plastic, rope or a fabric as opposed to string. The actual thickness and configuration of the handle also may vary depending on the application.

Figure 1:
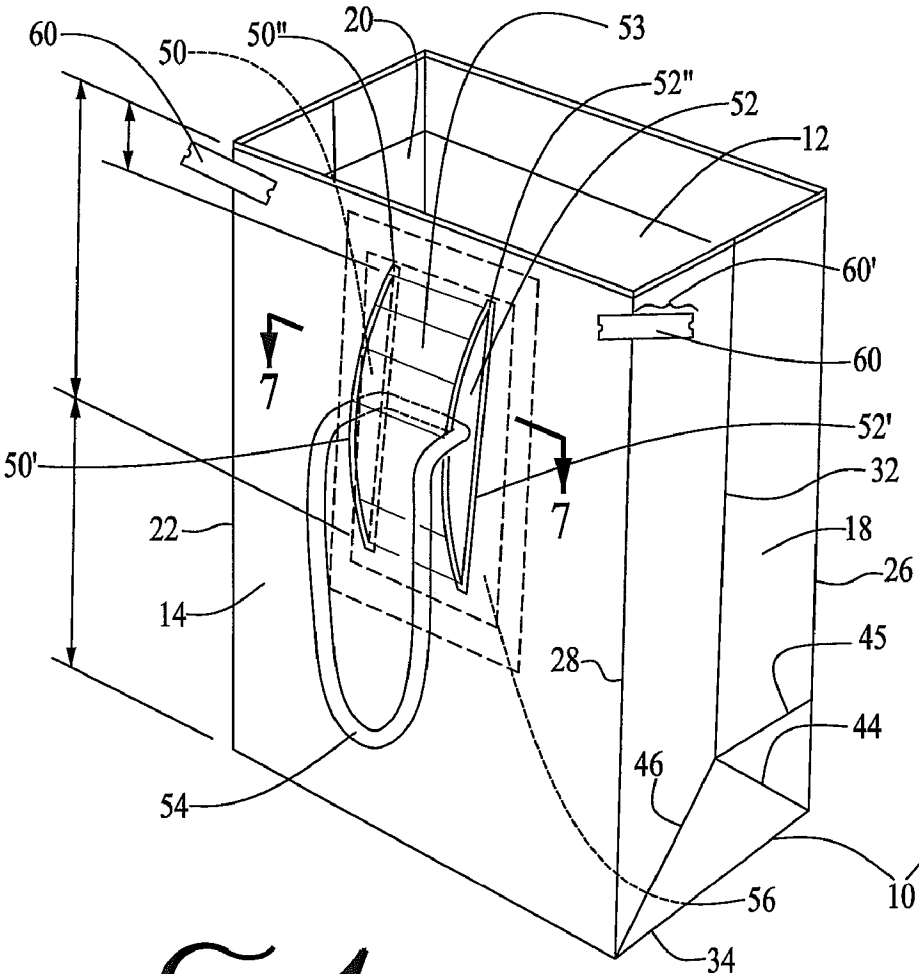
FIG. 1 is a rear perspective view of a first embodiment of the present invention illustrating the bag in the open position.
Figure 3:
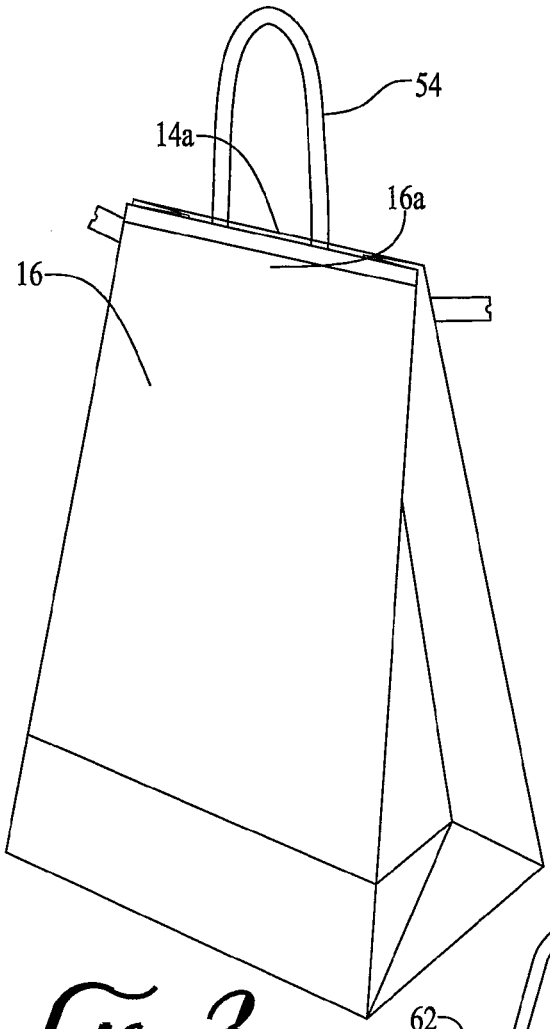
FIG. 3 is a front perspective view of the first embodiment after the upper open ends of the front and rear panels have been pressed together.
Figure 4:
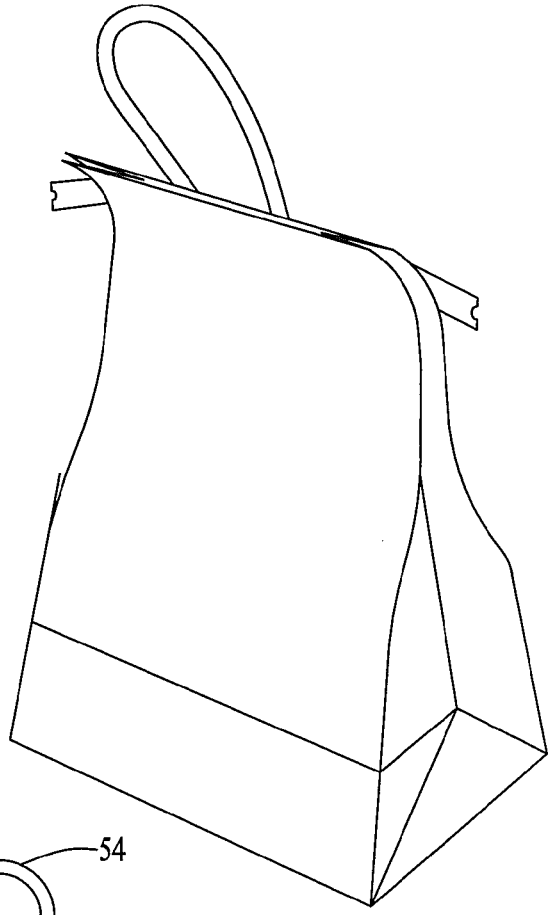
FIG. 4 is a front perspective view of the first embodiment after the upper end portions of the front and rear panels have been pressed together into an adjacent disposition and partially folded toward the front panel to close the container about the object(s) contained therein.
Figure 7:
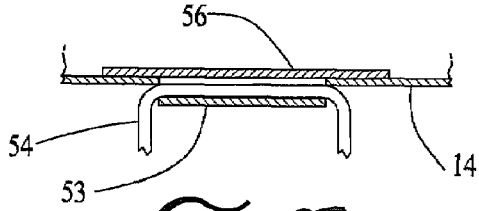
FIG. 7 is a cross-sectional view taken along line 7-7 in FIG. 1.

To prevent the handle from tangling with and possible dislodging the bag's contents, a second layer 56 of material, preferably the same material of which the bag 10 is formed, can be provided on the interior of the bag inwardly adjacent openings 50 and 52, the portion 53 of the bag extending therebetween, and the portion of the handle 54 extending about portion 53 (see FIGS. 1 and 7). This second protective layer 56 may be adhered to the rear panel 14 by adhesive, stitching or any other suitable means, depending on the material or materials of which the bag 10 is formed. Layer 56 is preferably secured about its perimeter so as not to interfere with the sliding movement of the handle 54. If desired, the openings or slits 50 and 52 may be reinforced along the perimeter edges 50' and 52' thereof (see FIGS. 5 and 6) to prevent the handle from ripping through the bag during use. Further, if desired additional slits or openings (not shown) could be provided in the rear bag panel 14 for aesthetic purposes and/or to accommodate one or more additional slideably mounted handles.

In the embodiment illustrated in FIGS. 1-9, a pair of fasteners or securement members 60 are provided on opposed sides of the rear panel proximate the upper ends thereof for securing the bag in a closed, folded disposition. The fastening members 60 could be adhesive strips, flexible plastic tabs, snaps, magnets, hook and pile fasteners or any other attachment means that would achieve the desired securement. For gift and shopping bag applications adhesive strips secured to the rear bag panel 14, as shown, with peel-away coverings protecting the adhesive on the cantilevered portions 60' of the strips provides an inexpensive and effective securement.

Figure 5:
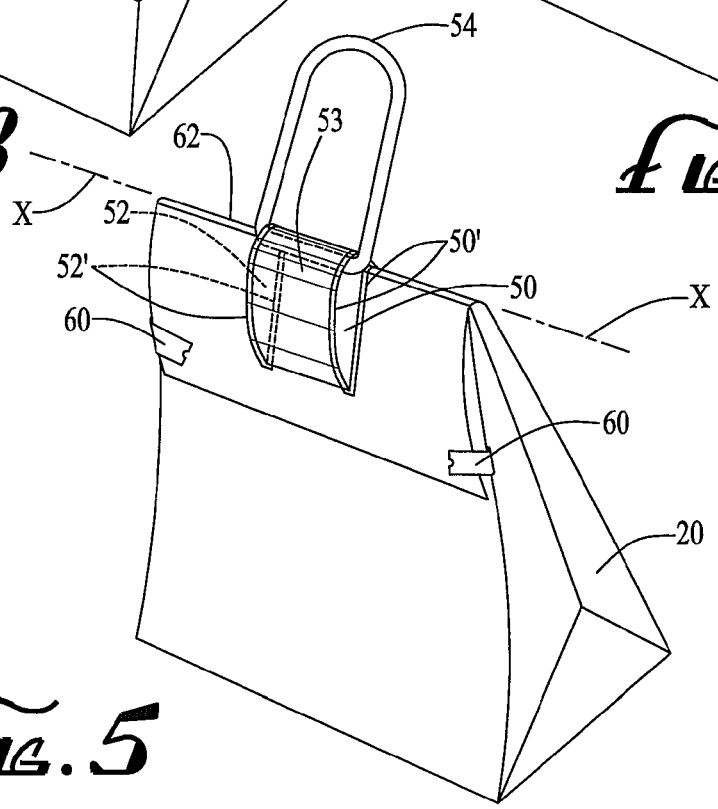
FIG. 5 is a front perspective view of the first embodiment showing the container folded and sealed about the object(s) therein with the adjacent upper end portions of the front and rear panels secured in place over the portion of the front panel disposed below the fold and the self-adjusting handle positioned at the top of the bag.
Figure 6:
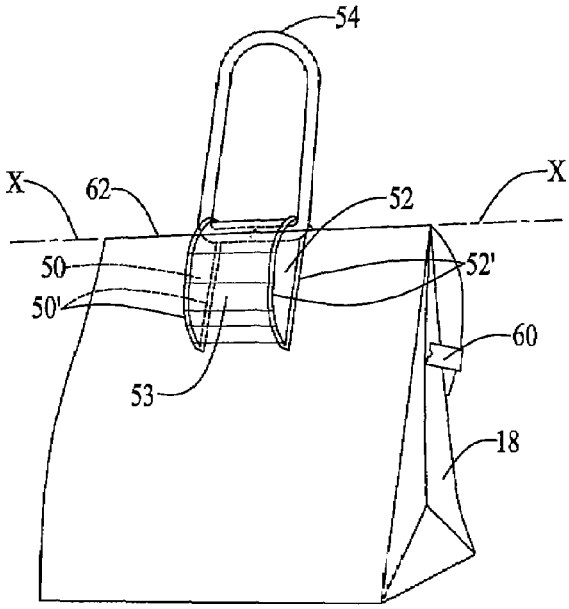
FIG. 6 is a rear perspective view of the first embodiment in the folded and sealed disposition of FIG. 5.

The use of bag 10 is illustrated in FIGS. 3-6 and 8 and 9. After the open bag 10 (see FIGS. 1 and 2) has been filled with one or more items, the bag 10 can be closed by manually pinching together the upper end portions 16*a* and 14*a* of the front and rear panels 16 and 14 so that the top edge portions of the front and rear panels are proximate to each other (see FIG. 3). The upper portions of the front and rear panels below upper ends 14*a* and 16*a* also are pressed together above the item(s) within the bag 10 (see FIG. 4) and the upper panel portions are then folded toward and against the front panel 16 from the position illustrated in FIG. 4 to the position illustrated in FIG. 5, forming a fold 62 that extends across the top of the bag 10 about a horizontal axis X as seen in FIG. 5. The fastening members are now positioned below or downstream of the fold 62 and act to secure the bag in the folded position. In the embodiment of the securement members 60 shown in FIGS. 1-6, the adhesive strips are pressed against adjacent portions of the side panels 18 and 20 (see FIG. 6) to secure the bag in its folded disposition. With other forms of fastening means, such as snaps, magnets, buttons, hook and pile fasteners, etc. the attachment point or area for the securement members may be on adjacent points or areas on the front panel itself as opposed to the side panels (see e.g. FIGS. 10 and 11). As noted above, any suitable attachment mechanism can be employed for securing the bag in its folded position.

Figure 8:
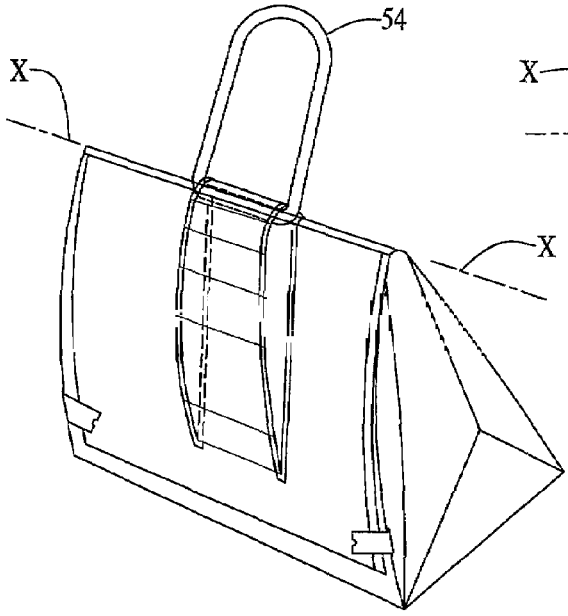
FIG. 8 is a front perspective view of the first embodiment of the present invention similar to that shown in FIG. 5 except that the front and rear panels are folded over further down the bag to encase a lesser volume.
Figure 9:
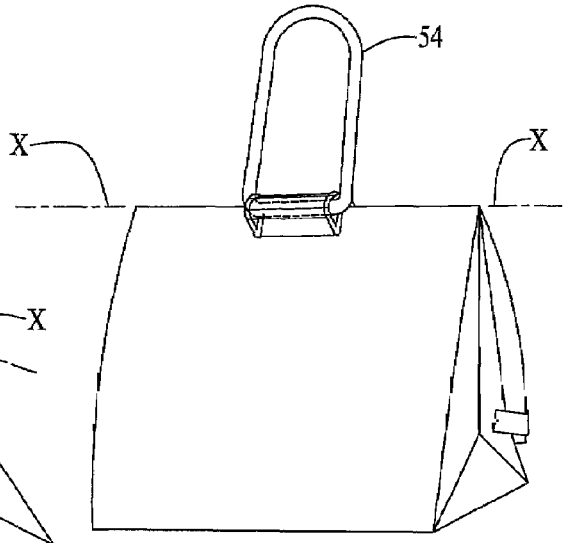
FIG. 9 is a rear perspective view of the first embodiment in the folded and sealed disposition of FIG. 8.

As seen in the drawings, the handle 54 is adjustable as a result of its freedom to slide along elongated openings 50 and 52 about the portion 53 of the rear panel 14 disposed therebetween. By positioning the upper ends 50" and 52" of the openings 50 and 52 (see FIG. 1) proximate the upper open end of bag 10 and extending the openings downwardly a distance equal to or just slightly less than one-half the height of the bag, the handle openings will always intersect the formed fold 62. As a result, regardless of the elevation of the horizontal axis X about which fold 62 is formed to encase different volumetric sizes, the handle can slide to the top of the folded bag for carrying. Accordingly, when the user lifts the bag and its contents using the handle 54, the handle will slide to the fold 62 at the top of the bag where the handle is properly centered for carrying the bag. This is illustrated in comparing FIGS. 5 and 6 with FIGS. 8 and 9. FIGS. 8 and 9 illustrate the bag 10 folded over and onto itself such that the top edge portions of the front and rear panels are proximate to the bottom of the bag. While the elevation of the axis X about which the fold 62 is formed is lower in this configuration than the elevation of the axis X illustrated in FIG. 5, the handle 54 still slides to the top center of the bag along elongated openings 50 and 52 into the ideal position for carrying. In this position, the volume of the bag is at its smallest unless the upper adjacent ends of the front and rear panels were folded about the bottom of the bag. In such an embodiment, the openings would be extended further down the rear panel to accommodate the further reduction in volumetric carrying capacity. Other variations in the length and positioning of openings 50 and 52 could be employed depending on the maximum and minimum volumes for which the bag is designed to encase.

Figure 10:
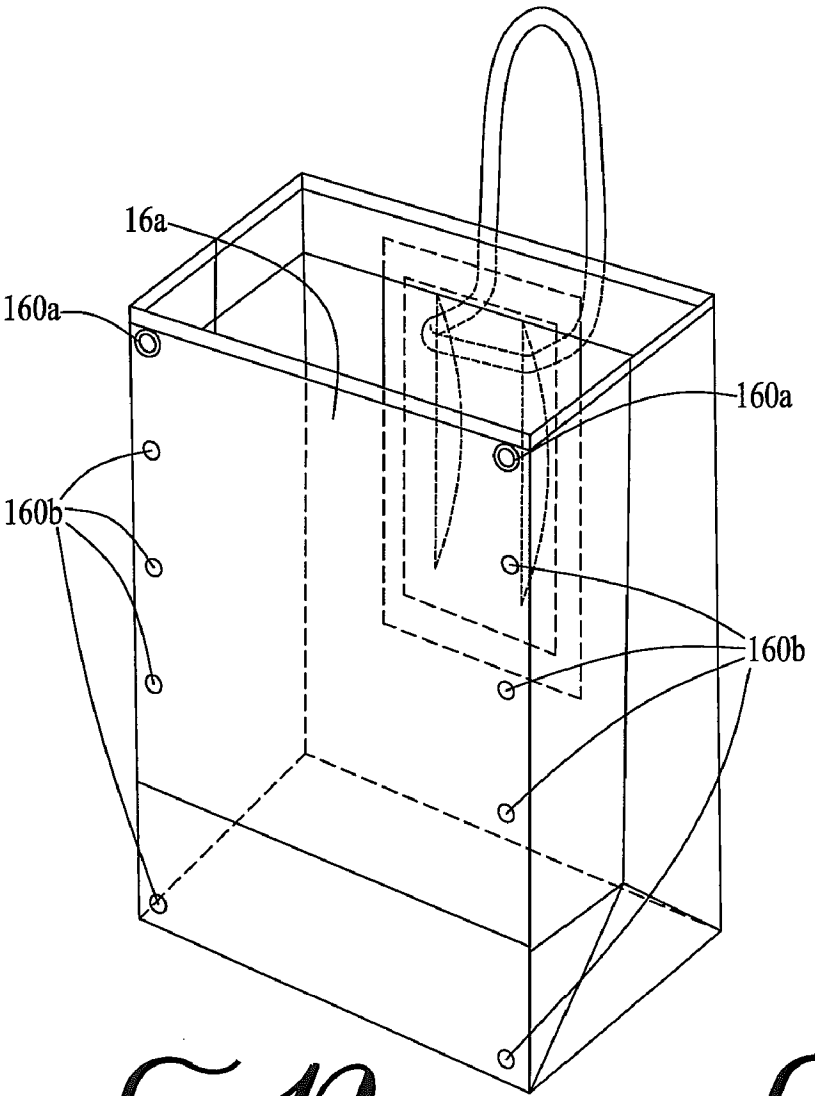
FIG. 10 is a front perspective view of an embodiment of the present invention utilizing snaps to close the bag and to secure the bag in a folded position.

As noted earlier herein, there are several different types of closures that could be utilized to close and secure the bag in the folded position. FIG. 10 illustrates an embodiment of the invention wherein a pair of laterally-spaced snaps 160*a* are provided on the upper end portions 16*a* of the front panel 16 that are adapted to cooperate with one of several sets of snaps 160*b* positioned at various elevations along the exterior side of the front panel below and in vertical alignment with snaps 160*a*. To close and secure the bag, one would pinch the top edge portions of the bag together, press the upper portions of the front and rear panels together and then fold the bag with the handle facing outwardly, as previously explained with reference to FIGS. 3-5. The snaps 160*a* are then engaged with the appropriate pair of aligned cooperating snaps 160*b*. As with the previous embodiments, the handle will slide to the top of the bag for easy carrying.

Figure 11:
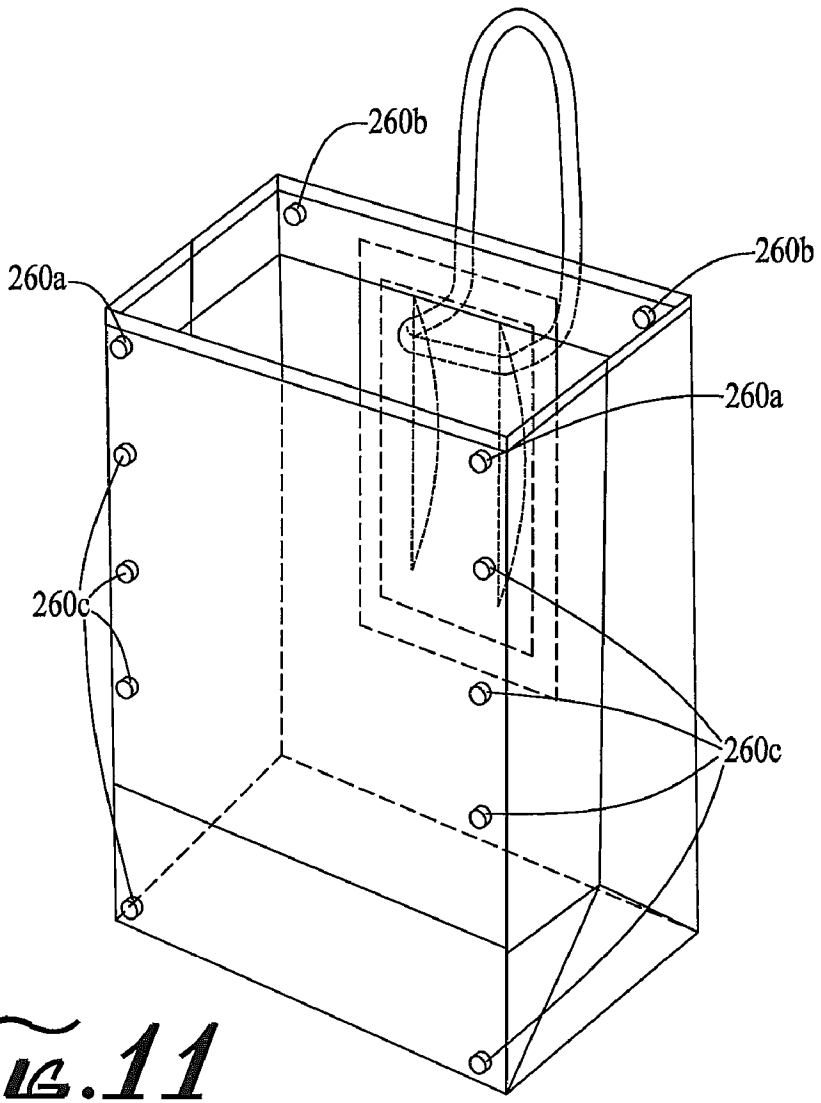
FIG. 11 is a front perspective view of an embodiment of this invention utilizing magnets to close the bag and to secure the bag in a folded position.

FIG. 11 shows another form of closure, wherein magnets are employed both to close the upper end of the bag and to secure the bag in the folded position. The concept is similar to the snap configuration illustrated in FIG. 10, but additionally provides a means for securing the bag in the folded state. As seen in FIG. 11, magnets 260*a* and 260*b* are provided proximate the upper ends of the front and rear bag panels. Those magnets are oriented to effect closure of the upper end of the bag. After the bag has been closed and folded (not shown), magnets 260*a* can cooperate with any of the appropriately aligned sets of pairs of lower magnets 260*c* to hold the bag in the folded disposition. The configuration of magnet fasteners illustrated in FIG. 11 not only holds the bag in a folded disposition by maintaining the upper portion of the front panel 16 against the lower portion of the front panel, it also holds the ends of the bag together in a closed disposition. It should be noted, however, that additional sets of opposed and cooperating snaps could be provided in the interior of the bag illustrated in FIG. 10 proximate the upper ends of the front and rear bag panels to secure the upper panel ends together in the folded position so as to enhance the appearance of the bag in the folded position as is achieved by magnets 260*a* and 260*b* in FIG. 11. Again, other fastening members could be employed in lieu of the above-discussed pre-applied adhesive strips, snaps and magnets. Examples of such closures include but are not limited to: hook and pile fasteners, buttons, ribbons, twine, hooks, and buckles, etc. While the number and positioning of the fastening members can be varied in all of these embodiments, the fastening members, regardless of their structure, should be positioned in a manner that allows them to fold and close the bag at different elevations to provide the bag with an adjustable interior capacity for differently sized contents.

Figure 13:
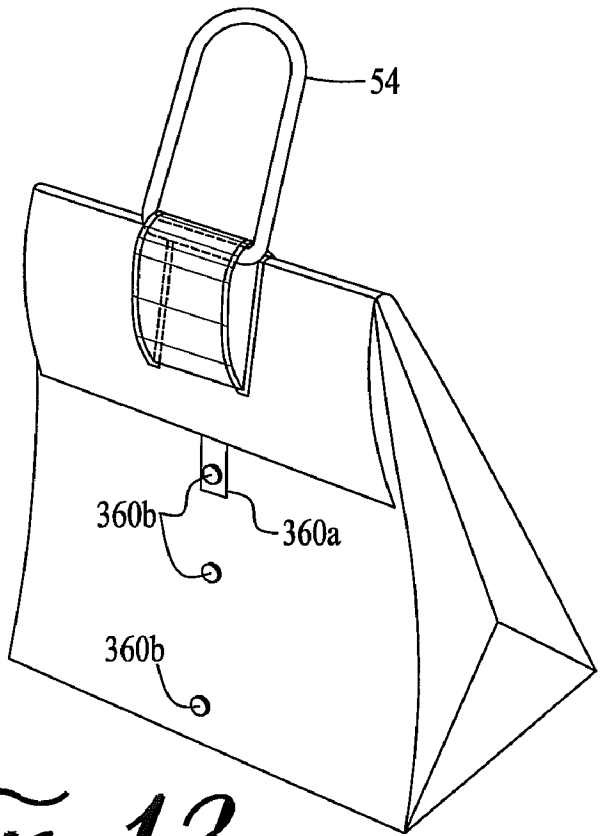
FIG. 13 is a front perspective view of the embodiment illustrated in FIG. 12 after the bag has been closed, folded and secured, with the adjustable handle positioned at the top of the bag.
Figure 12:
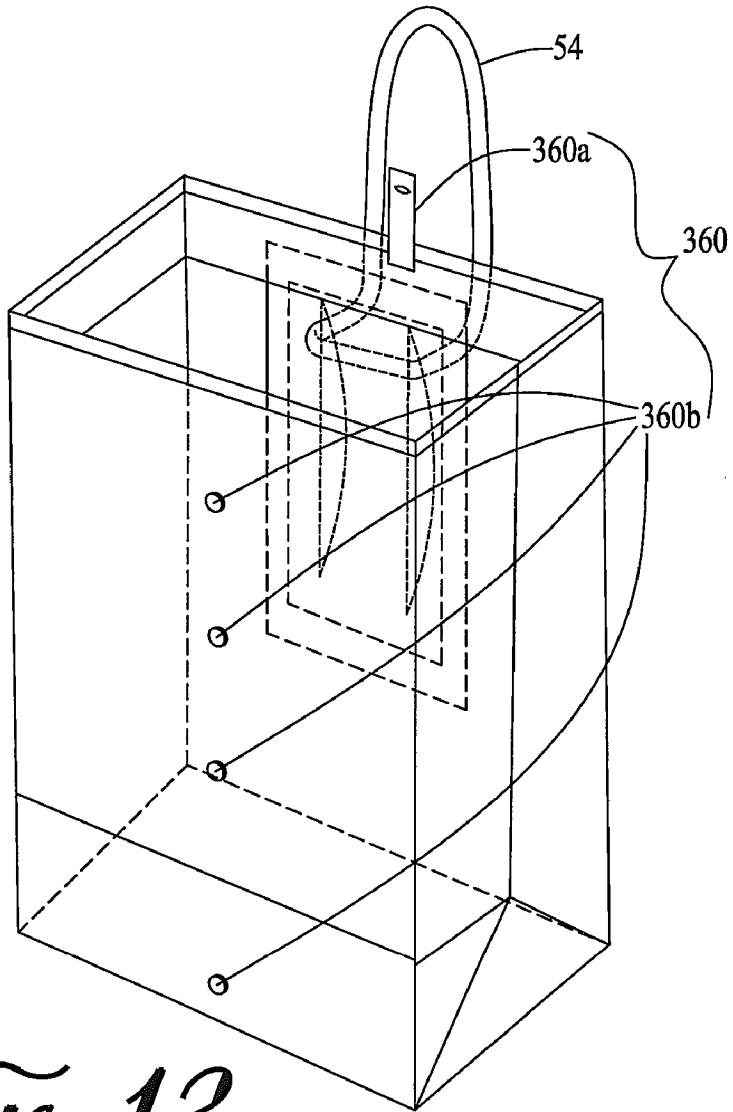
FIG. 12 is a front perspective view of an embodiment of this invention with a strip attached to the back panel that secures the bag in a folded position.

FIGS. 12 and 13 illustrate an alternative way to close the bag and to secure the bag in a folded position. In this embodiment, the fastening members 360 are comprised of a separate strap or length of material 360*a* attached to and extending from the back panel and a series of complimentary vertically-spaced fastening members 360*b* positioned on the front panel in vertical alignment with strap 360*a*. FIG. 13 illustrates the bag secured in the folded position. Through such a configuration, the bag can be secured in various folded positions by connecting the strap 360*a* to any one different complimentary fastening members 360*b* on the front panel. Straps 360*a* could have a buttonhole formed therein for receiving the fastening members 360*b* or have a mating fastening member secured thereto for attachment with any one of the aligned fastener members 360*b*. Again, more than one strap 360*a* and a single column of complementary fastening members 360*b* could be employed.

Figure 15:
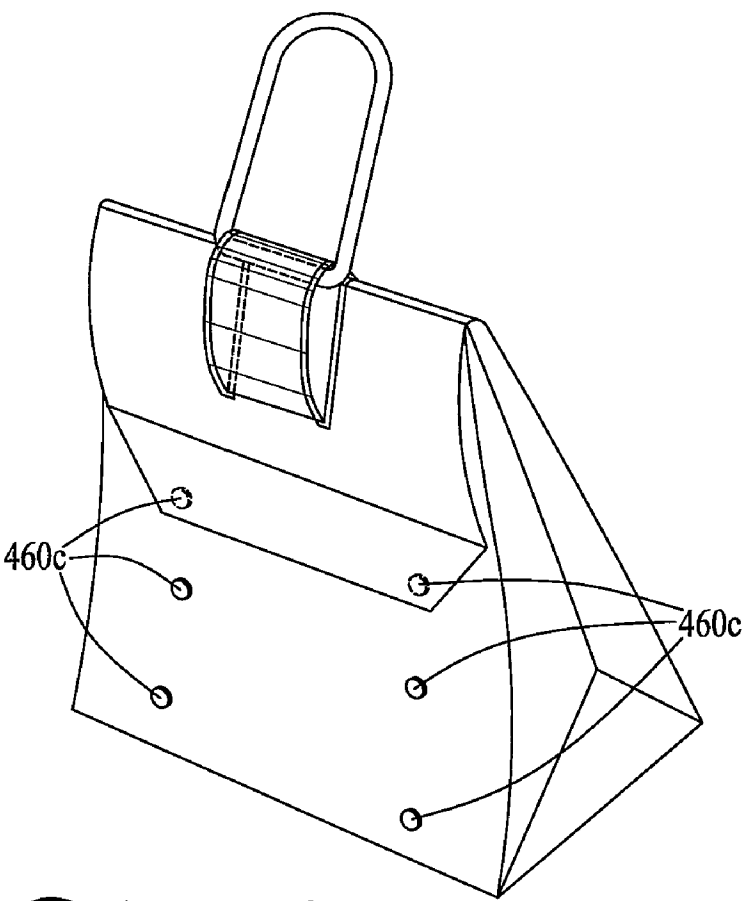
FIG. 15 is a front perspective view of the embodiment illustrated in FIG. 14 after the bag has been closed, folded and secured, with the adjustable handle position at the top of the bag.
Figure 14:
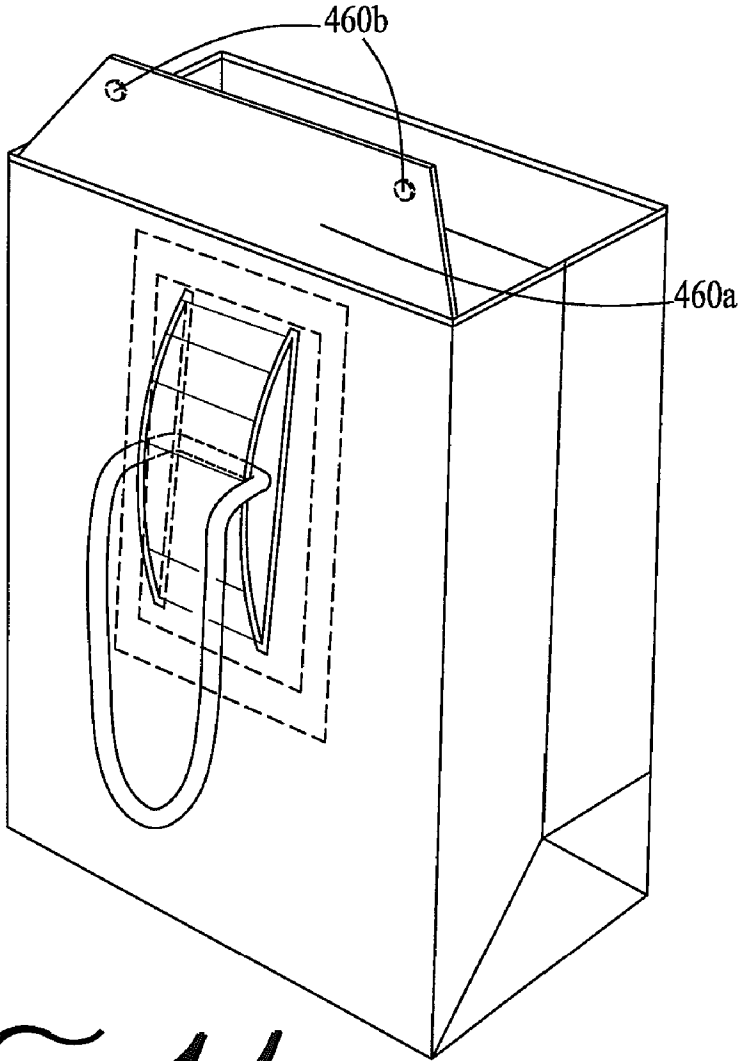
FIG. 14 is a rear perspective view of an embodiment of this invention with a flap attached along the back panel that secures the bag in a folded position.

FIGS. 14 and 15 illustrate a similar embodiment to the one shown in FIGS. 12 and 13 wherein the attachment strap extends along the upper edge of the rear panel to form a flap 460*a*. The flap 460*a* could carry a pair of fastening members 460*b* for selective engagement with one of the aligned pairs of fastening members 460*c* located on the front panel of the bag. FIG. 14 shows such a bag in a folded state. The number and positioning of the fasteners on flap 460*a*, the number of sets of fasteners 460*c* and the number of fasteners 460*c* in each set could be increased or decreased as desired.

The embodiments of the invention depicted in FIGS. 12-15 each contain an additional piece of material (e.g. strap or flap) extending from the rear bag panel. Depending on the length of the extended material, the bag may be able to be secured in a closed disposition without being folded over itself. In such a case, the laterally-spaced elongated openings may be extended to the upper edge of the back panel in the case of the thin strap 360*a* illustrated in FIGS. 12 and 13 or into the extended flap 460*a* in the case of the embodiment illustrated in FIGS. 14 and 15 in order for the handle to be adjustable to be positioned at the top of the bag in an unfolded disposition or at the fold in the manner previously described.

In the above-described embodiments, the invention has been described in terms of a bag with front, rear and side panels. However, the bag or other container embodying the present invention does not require the use of panels. An embodiment of the present invention may comprise a bag that has no panels but is still capable of being folded and secured at different positions and is provided with an outwardly extending slidable and self-centering handle. As indicated earlier herein, while the above-described embodiments made specific reference to gift and shopping bags, the invention is not so limited. The present invention has many other applications including but not limited to: an adjustable purse; an adjustable tote bag or luggage, allowing a traveler who might start the trip with a few items but need to add or remove items during the trip the ability to expand or retract the bag to fit the contents; an adjustable lunch food bag (bigger at the beginning of the day, wrapped smaller for end of the day after lunch has been eaten); an adjustable gym bag; a picnic bag; and a utility bag. These containers may or may not contain panels but are nevertheless closable as above-described and are provided with the self-centering handle of the present invention.

Figure 16:
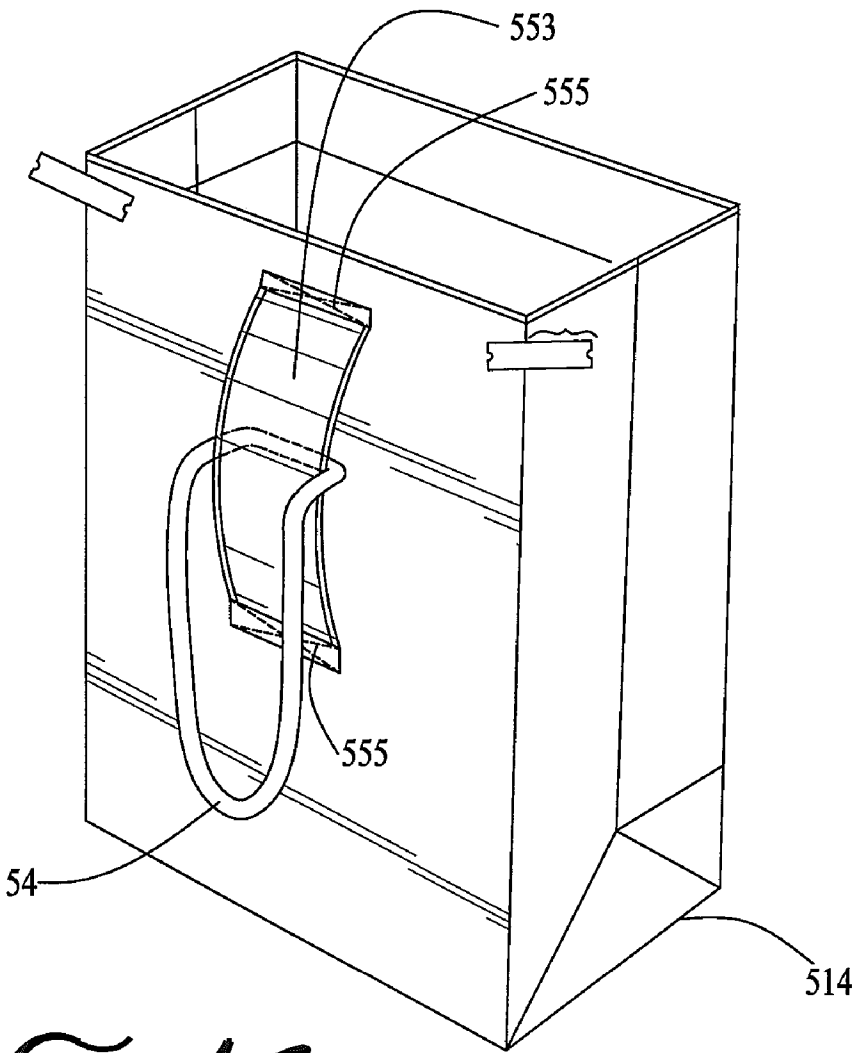
FIG. 16 is a rear perspective view of another embodiment of the present invention.

In a variation of the present invention illustrated in FIG. 16, an additional strip 553 of material, preferably of the same material as that of which the bag is formed, is stitched at 555 or, is adhesively or otherwise suitably attached to the exterior of the rear panel 514 of the bag in lieu of the elongated openings 50 and 52 in the prior embodiments. Thus, in the embodiment of FIG. 16, the handle 54 would extend about strip 555 so as to be slidable therealong, as opposed to extending through openings 50 and 52 and about the panel portion 53 disposed therebetween. This embodiment of the present invention seemingly would be better suited for applications other than paper gift and shopping bags such as purses, tote bags and the like.

Although the present invention has been described by way of exemplary embodiments, it should be understood that many changes and modifications may be made by those skilled in the art in carrying out the present invention without departing from the spirit and the scope thereof, as those changes and modifications are within the purview of the appended claims, they are considered to be part of the present invention.

What is claimed is:

1. An adjustable carrying bag having an open upper end and a closed lower end, said bag comprising:

a front panel and a rear panel, said rear panel defining a pair of laterally spaced and vertically elongated openings therein, said panels being foldable about a horizontal axis that is vertically variable along said openings such that an upper portion of said front panel is at least substantially adjacent to a lower portion of said front panel and an upper portion of said rear panel is at least substantially adjacent to said upper portion of said front panel so as to form a fold intersecting said openings and closing said bag whereby varying the vertical elevation of the fold, varies the volumetric area of the bag;

means for releasably securing said front and rear panels in a folded disposition about said axis; and a handle extending through said openings so as to be slidable along said openings such that upon folding said front and rear panels about said axis to define said fold, securing said panels in the folded disposition and lifting said bag by said handle, said handle will slide along said openings to said fold for carrying the bag.

2. The carrying bag of claim 1 wherein said bag includes a pair of opposed foldable side panel whereby said bag can be folded into a substantially flat disposition.

3. The carrying bag of claim 1 wherein said handle defines a closed loop extending through said openings and about a portion of said rear panel disposed therebetween.

4. The carrying bag of claim 1 wherein said elongated openings extend from a first elevation proximate said open upper end of said bag to a second elevation proximate one-half the distance between said open upper end and said closed lower end of said bag.

5. The carrying bag of claim 1 wherein said releasable securing means includes a first plurality of attachment members carried by said front and rear panels proximate said upper end of said bag for closing the upper open end of said bag and a second plurality of attachment members carried by said front panel of said bag for securing said upper portion of said front panel to a lower portion of said front panel, said second plurality of fastening members including vertically spaced and axially aligned fastening members for securement of said upper portion of said front panel at different elevations along said front panel.

6. The carrying bag of claim 1 wherein said releasable securing means comprises a pair of adhesive backed strips carried by opposed lateral portions of said rear panel proximate said open upper end of said bags.

7. The carrying bag of claim 6 wherein said elongated openings extend from a first elevation proximate said open upper end of said bag to a second elevation proximate one-half the distance between said open upper end and said closed lower end of said bag.

8. An adjustable carrying bag having an open upper end and a closed lower end, said bag comprising:

a front panel and a rear panel, wherein said rear panel defines a pair of laterally spaced elongated openings therein, said panels being foldable about a horizontal axis that is vertically variable alone said openings such that an upper portion of said front panel is at least substantially adjacent to a lower portion of said front panel and an upper portion of said rear panel is at least substantially adjacent to said upper portion of said front panel so as to form a fold intersecting said openings and closing said bag whereby varying the vertical elevation of the fold, varies the volumetric area of the bag;

means for releasably securing said front and rear panels in a folded disposition about said axis, said means including a first plurality of attachment members carried by said front and rear panels proximate said upper end panels of said bag for closing said upper end of said bag and a second plurality of attachment members carried by said front panel of said bag for securing said upper portion of said front panel to a lower portion of said front panel, said second plurality of fastening members including vertically spaced and axially aligned fastening members for securement of said upper portion of said front panel at different elevations along said front panel; and a handle extending through said openings and about a portion of said rear panel disposed therebetween so as to be slidable along said openings such that upon folding said front and rear panels about said axis to define said fold, securing said panels in the folded disposition and lifting said bag by said handle, said handle will slide to said fold for carrying the bag.

9. The carrying bag of claim 8 wherein said elongated openings extend from a first elevation proximate said open upper end of said bag to a second elevation proximate one-half the distance between said open upper end and said closed lower end of said bag.

10. The carrying bag of claim 8 wherein said bag includes a pair of opposed foldable side panel whereby said bag can be folded into a substantially flat disposition.

11. An adjustable carrying bag having an open upper end and a closed lower end, said bag comprising:

a front panel and a rear panel, said panels being foldable about a vertically variable horizontal axis such that an upper portion of said front panel is at least substantially adjacent to a lower portion of said front panel and an upper portion of said rear panel is at least substantially adjacent to said upper portion of said front panel so as to form a fold closing said bag whereby varying the vertical elevation of the fold, varies the volumetric area of the bag;

means for releasablv securing said front and rear panels in a folded disposition about said axis;

a length of material secured to said rear panel along an exterior side thereof; and a handle extending said about said length of material so as to be slidable therealong such that upon folding said front and rear panels about said axis to define said fold such that said fold intersects said length of material, securing said panels in the folded disposition and lifting said bag by said handle, said handle will slide to said fold for carrying the bag.

12. The carrying bag of claim 11 wherein said releasable securing means includes a first plurality of attachment members carried by said front and rear panels proximate said upper end of said bag for closing the upper open end of said bag and a second plurality of attachment members carried by said front panel of said bag for securing said upper portion of said front panel to a lower portion of said front panel, said second plurality of fastening members including vertically spaced and axially aligned fastening members for securement of said upper portion of said front panel at different elevations along said front panel.

13. An adjustable carrying bag having an open upper end and a closed lower end, said bag comprising:

front and rear wall portions, said wall portions being foldable in an adjacent juxtaposition about a variable horizontal axis so as to form a fold closing said bag whereby varying the elevation of the fold, varies the volumetric area of the bag;

a pair of laterally spaced and vertically elongated openings in an upper portion of said rear wall portion;

means for releasably securing said front and rear wall portions in a folded disposition about said axis; and a handle extending through said openings and about a portion of said rear panel disposed therebetween so as to be slidable alone said openings such that upon folding said front and rear wall portions of said bag about said axis to define said fold such that said fold intersects said openings, securing said wall portions in the folded disposition and lifting said bag by said handle, said handle will slide to said fold for carrying the bag.

14. The carrying bag of claim 13 wherein said handle defines a closed loop extending through said openings and about said portion of said rear wall portion disposed therebetween.

15. The carrying bag of claim 13 wherein said elongated openings extend from a first elevation proximate said open upper end of said bag to a second elevation proximate one-half the distance between said open upper end and said closed lower end of said bag.

16. The carrying bag of claim 13 wherein said releasable securing means includes a first plurality of attachment members carried by said front and rear wall portions proximate said upper end of said bag for closing the upper open end of said bag and a second plurality of attachment members carried by said front wall portion of said bag for securing said upper portion of said front wall portion to a lower portion of said front wall portion, said second plurality of fastening members including vertically spaced and axially aligned fastening members for securement of said upper portion of said front wall portion at different elevations along said front wall portion.

17. The carrying bag of claim 16 wherein said elongated openings extend from a first elevation proximate said open upper end of said bag to a second elevation proximate one-half the distance between said open upper end and said closed lower end of said bag.

18. An adjustable carrving bag having an open upper end and a closed lower end, said bag comprising:

front and rear wall portions, said rear wall portion of said bag defining a pair of laterally spaced elongated openings therein, said wall portions being foldable in an adjacent juxtaposition about a variable horizontal axis so as to form a fold closing said bag whereby varying the elevation of the fold, varies the volumetric area of the bag;

means for releasably securing said front and rear wall portions in a folded disposition about said axis; and a handle extending through said openings and about a portion of said rear wall portion disposed therebetween so as to be slidable along said openings such that upon folding said front and rear wall portions of said bag about said axis to define said fold, securing said wall portions in the folded disposition and lifting said bag by said handle, said handle will slide to said fold for carrying the bag.

19. The carrying bag of claim 18 wherein said handle defines a closed loop extending through said openings and about a portion of said rear panel disposed therebetween.

20. The carrying bag of claim 18 wherein said elongated openings extend from a first elevation proximate said open upper end of said bag to a second elevation proximate one-half the distance between said open upper end and said closed lower end of said bag.

21. The carrying bag of claim 18 wherein said releasable securing means includes a first plurality of attachment members carried by said front and rear panels proximate said upper end of said bag for closing the upper open end of said bag and a second plurality of attachment members carried by said front panel of said bag for securing said upper portion of said front panel to a lower portion of said front panel, said second plurality of fastening members including vertically spaced and axially aligned fastening members for securement of said upper portion of said front panel at different elevations along said front panel.

22. An adjustable carrying bag having an open upper end and a closed lower end, said bag comprising:

front and rear wall portions, said wall portions being foldable in an adjacent juxtaposition about a variable horizontal axis so as to form a fold closing said bag whereby varying the elevation of the fold, varies the volumetric area of the bag;

a length of material secured to said rear panel along an exterior side thereof;

means for releasably securing said front and rear wall portions in a folded disposition about said axis; and a handle extending about said length of material so as to be slidable therealong such that upon folding said front and rear wall portions of said bag about said axis to define said fold, securing said wall portions in the folded disposition and lifting said bag by said handle, said handle will slide to said fold for carrying the bag.

23. The carrying bag of claim 22 wherein said releasable securing means includes a first plurality of attachment members carried by said front and rear panels proximate said upper end of said bag for closing the upper open end of said bag and a second plurality of attachment members carried by said front panel of said bag for securing said upper portion of said front panel to a lower portion of said front panel, said second plurality of fastening members including vertically spaced and axially aligned fastening members for securement of said upper portion of said front panel at different elevations along said front panel.

* * * * *